US011231181B2

(12) United States Patent
Miyazaki et al.

(10) Patent No.: US 11,231,181 B2
(45) Date of Patent: Jan. 25, 2022

(54) HEATING AND HOT-WATER SUPPLY APPARATUS

(71) Applicant: Rinnai Corporation, Aichi (JP)

(72) Inventors: Yuya Miyazaki, Aichi (JP); Atsushi Fukaya, Aichi (JP)

(73) Assignee: Rinnai Corporation, Aichi (JP)

( * ) Notice: Subject to any disclaimer, the term of this patent is extended or adjusted under 35 U.S.C. 154(b) by 115 days.

(21) Appl. No.: 16/729,574

(22) Filed: Dec. 30, 2019

(65) Prior Publication Data

US 2020/0292179 A1 Sep. 17, 2020

(30) Foreign Application Priority Data

Mar. 14, 2019 (JP) ..... JP2019-047543

(51) Int. Cl.

| | |
|---|---|
| ***F24D 3/08*** | (2006.01) |
| ***F24D 17/02*** | (2006.01) |
| *F24H 1/52* | (2006.01) |
| *F24H 9/20* | (2006.01) |
| *F24D 19/10* | (2006.01) |

(52) U.S. Cl.

CPC ..... *F24D 3/08* (2013.01); *F24D 17/02* (2013.01); *F24D 19/1069* (2013.01); *F24D 2200/12* (2013.01); *F24D 2220/042* (2013.01); *F24D 2220/044* (2013.01); *F24H 1/52* (2013.01); *F24H 9/2035* (2013.01)

(58) Field of Classification Search

USPC ..... 237/8 A

See application file for complete search history.

(56) References Cited

U.S. PATENT DOCUMENTS

2018/0073749 A1* 3/2018 Gagne ..... F24D 19/1066
2018/0314275 A1* 11/2018 Aoki ..... G05D 23/1333
2021/0080120 A1* 3/2021 Morimoto ..... F24H 1/523

FOREIGN PATENT DOCUMENTS

JP 2018-185082 A 11/2018

* cited by examiner

*Primary Examiner* — Steven B McAllister
*Assistant Examiner* — John E Bargero
(74) *Attorney, Agent, or Firm* — Nakanishi IP Associates, LLC

(57) ABSTRACT

A heating and hot-water supply apparatus shortens the time taken for hot-water supply to stabilize at a set temperature in response to a request for a hot-water supply operation during a heating operation. The apparatus performs, using a common heating medium heated by a heater, a heating operation by circulating the heating medium through a heating terminal, and a hot-water supply operation of heating service water through heat exchange with the heating medium circulated through a hot-water supply heat exchanger and supplying hot water. A distribution unit (three-way valve) changes a distribution ratio of the heating medium between the heating terminal and the hot-water supply heat exchanger. A controller controls an amount of heat generated by the heater for the heating operation or the hot-water supply operation, and stops heating with the heater when the temperature of the heating medium reaches a predetermined upper-limit temperature.

6 Claims, 9 Drawing Sheets

*Prior Art*

HEATING AND HOT-WATER SUPPLY APPARATUS

BACKGROUND OF INVENTION

Field of the Invention

The present invention relates to a heating and hot-water supply apparatus that performs, using a common heating medium, a heating operation by circulating the heating medium through a heating terminal, and a hot-water supply operation of heating service water through heat exchange with the heating medium circulated through a hot-water supply heat exchanger and supplying hot water.

Background Art

Heating and hot-water supply apparatuses have been developed to perform a heating operation of heating a heating medium with a burner or another heating unit (heater) and circulating the heating medium through a heating terminal, and a hot-water supply operation of circulating the common heating medium through a hot-water supply heat exchanger to heat service water through heat exchange with the heating medium and supplying hot water (e.g., Patent Literature 1). Such a heating and hot-water supply apparatus includes a distribution unit such as a three-way valve for changing the distribution ratio of the heated heating medium between the heating terminal and the hot-water supply heat exchanger. In response to a request for the hot-water supply operation during the heating operation, the heating and hot-water supply apparatus causes the distribution unit to change the distribution ratio. A hot-water supply operation typically uses more heat than a heating operation, and thus the amount of heat generated by the heater is increased from the amount of heat for the heating operation to the amount of heat for the hot-water supply operation. When the temperature of the heating medium reaches a predetermined upper-limit temperature, the heater stops heating to prevent the heating medium from overheating.

CITATION LIST

Patent Literature

Patent Literature 1: Japanese Unexamined Patent Application Publication No. 2018-185082

However, such a heating and hot-water supply apparatus capable of implementing a heating operation and a hot-water supply operation with a common heating medium may receive a request for the hot-water supply operation during the heating operation. In this case, the hot-water supply takes time to stabilize at a set temperature for the reason below. To change the distribution ratio, the distribution unit takes a time period longer than a time period for increasing the amount of heat generated by the heater to an amount appropriate for the hot-water supply operation. Due to this time lag, a large amount of heating medium heated to the amount appropriate for the hot-water supply operation flows to the heating terminal. The heat of the heating medium to be consumed in the hot-water supply heat exchanger circulates without being consumed, causing a sudden increase in the temperature of the heating medium. Then, the temperature of the heating medium reaches the upper-limit temperature, and the heater stops heating. After the heater restarts heating, the hot-water supply takes time to stabilize at a set temperature.

SUMMARY OF INVENTION

One or more aspects of the present invention are directed to a technique for shortening the time taken for hot-water supply to stabilize at a set temperature in response to a request for the hot-water supply operation during the heating operation of a heating and hot-water supply apparatus.

A heating and hot-water supply apparatus according to one aspect of the present invention has the structure below.

The heating and hot-water supply apparatus is an apparatus for performing, using a common heating medium, a heating operation by circulating the heating medium through a heating terminal, and a hot-water supply operation of heating service water through heat exchange with the heating medium circulated through a hot-water supply heat exchanger and supplying hot water. The apparatus includes a heater that heats the heating medium, a temperature sensor that senses a temperature of the heating medium, a distribution unit that changes a distribution ratio of the heating medium distributed between the heating terminal and the hot-water supply heat exchanger, and a controller that controls an amount of heat generated by the heater in accordance with the heating operation or the hot-water supply operation, and stops heating with the heater when the temperature of the heating medium reaches a predetermined upper-limit temperature. In response to a request for the hot-water supply operation during the heating operation, the distribution unit starts changing the distribution ratio, and the control unit sets a regulation period for regulating the amount of heat generated by the heater to less than an amount of heat for the hot-water supply operation.

In response to a request for the hot-water supply operation during the heating operation, the heating and hot-water supply apparatus according to this aspect of the invention sets a regulation period for regulating the amount of heat generated by the heater. The period delays the heating medium starting to be heated in an amount appropriate for the hot-water supply operation. This prevents the temperature of the heating medium from reaching an upper-limit temperature, and shortens the time taken for the hot-water supply to stabilize at the set temperature without unnecessarily stopping heating by the heater.

In the heating and hot-water supply apparatus according to the above aspect, the regulation period may have a length being a time taken for the distribution unit to change the distribution ratio.

The sudden increase in the temperature of the heating medium occurs when the heating medium heated in an amount appropriate for the hot-water supply operation flows to the heating terminal while the distribution unit is changing the distribution ratio. Thus, with the regulation period having no less than the time taken for changing by the distribution unit, the amount of heat generated by the heater is prevented from being over regulated for the hot-water supply operation. This reduces a delay in the stabilization of the hot-water supply at a set temperature.

The heating and hot-water supply apparatus according to the above aspect may end the regulation period when the temperature of the heating medium is lower than a predetermined reference temperature below the upper-limit temperature.

With this structure, when the temperature of the heating medium is not significantly high, and heating in an amount appropriate for the hot-water supply operation is less likely to overheat the heating medium (to the upper-limit temperature), the regulation period ends earlier to shift the amount of heat generated by the heater to the amount of heat for the hot-water supply operation. This allows the hot-water supply to stabilize earlier at a set temperature.

The heating and hot-water supply apparatus according to the above aspect may end the regulation period when a difference between an amount of heat for the hot-water supply operation and an amount of heat for the heating operation is less than a predetermined amount.

With this structure, when the amount of heat for the hot-water supply operation is not significantly greater than the amount of heat for the heating operation, and heating in an amount appropriate for the hot-water supply operation is less likely to overheat the heating medium (to the upper-limit temperature), the regulation period ends earlier to shift the amount of heat generated by the heater to the amount of heat for the hot-water supply operation. This allows the hot-water supply to stabilize earlier at a set temperature.

The heating and hot-water supply apparatus according to the above aspect may keep the amount of heat generated by the heater during the regulation period at the amount of heat for the heating operation.

With this structure, the same amount of heat is kept during the regulation period as before the distribution unit starts changing the distribution ratio. This regulates the temperature of the heating medium to lower than the upper-limit temperature, reliably preventing unnecessary stop of heating by the heater.

The heating and hot-water supply apparatus according to the above aspect may monotonically increase the amount of heat generated by the heater during the regulation period toward the amount of heat for the hot-water supply operation.

During the regulation period, the heating medium flowing to the hot-water supply heat exchanger increases as the distribution unit changes the distribution ratio, and the heat of the heating medium is consumed through heat exchange with service water in the hot-water supply heat exchanger. Thus, the monotonical increase in the amount of heat generated by the heater prevents the temperature of the heating medium from reaching the upper-limit temperature. The amount of heat generated by the heater, while regulated, monotonically approaches the amount of heat for the hot-water supply operation, shortening the time taken for the hot-water supply to stabilize at the set temperature.

DETAILED DESCRIPTION

Figure 1:
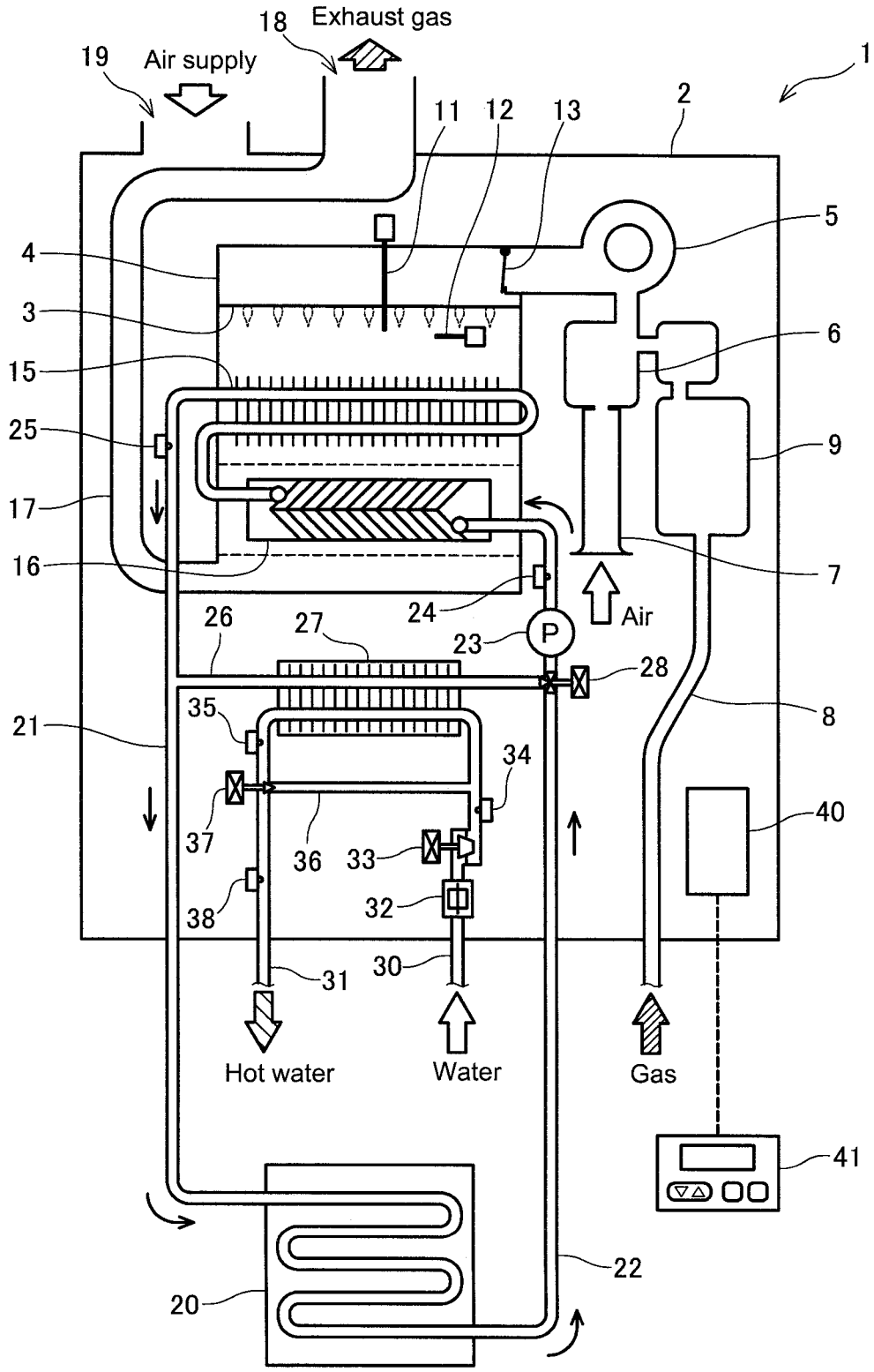
FIG. 1 is a schematic view of a heating and hot-water supply apparatus 1 according to one embodiment showing its structure.

FIG. 1 is a schematic view of a heating and hot-water supply apparatus 1 according to the present embodiment showing its structure. As shown in the figure, the heating and hot-water supply apparatus 1 includes a housing 2 containing a combustion unit 4 that includes a built-in burner 3 for burning mixture gas of fuel gas and combustion air. The combustion unit 4 is connected to a combustion fan 5, which feeds the mixture gas.

The inlet of the combustion fan 5 is adjacent to a joint 6 at which an air supply channel 7 for supplying combustion air meets a gas supply channel 8 for supplying fuel gas. The gas supply channel 8 includes an open-close valve (not shown) for opening and closing the gas supply channel 8, and a zero governor 9 for lowering the pressure of fuel gas fed from upstream under pressure to the atmospheric pressure. The joint 6 contains a switching valve, which can adjust the ratio of combustion air and fuel gas to flow into the combustion fan 5. When the combustion fan 5 is driven, the air in the housing 2 and the fuel gas downstream from the zero governor 9 in the gas supply channel 8 are drawn into the combustion fan 5 through the joint 6 at a predetermined ratio, and the resultant mixture gas is then fed to the combustion unit 4.

In the combustion unit 4, the built-in burner 3 burns the mixture gas. In the illustrated example, the burner 3 ejects the mixture gas downward, generating downward flames and feeding the combustion exhaust gas downward. The combustion fan 5 is electrically connected to a controller 40 controlling the entire heating and hot-water supply apparatus 1. The controller 40 controls the amount of combustion at the burner 3 by changing the rotational speed of the combustion fan 5 in accordance with the amount of heat to be used. The burner 3 in the present embodiment corresponds to a heater in an aspect of the present invention. The controller 40 in the present embodiment corresponds to a controller in an aspect of the present invention.

The combustion unit 4 includes a spark plug 11 sparking by a high-voltage discharge, a flame rod 12 sensing the flames of the burner 3, and a check valve 13 preventing a backflow from the combustion unit 4 to the combustion fan 5. The spark plug 11 and the flame rod 12 are electrically connected to the controller 40.

The burner 3 is underlain by a first heat exchanger 15, which is also underlain by a second heat exchanger 16. The combustion exhaust gas generated through combustion by the burner 3 is fed downward through the first heat exchanger 15 and the second heat exchanger 16. The first heat exchanger 15 collects sensible heat from the combustion exhaust gas, and the second heat exchanger 16 collects latent heat from the combustion exhaust gas.

The combustion exhaust gas that has passed through the first heat exchanger 15 and the second heat exchanger 16 then travels along an exhaust duct 17, and is discharged through an exhaust port 18 protruding from the top of the housing 2. In the illustrated example, the housing 2 has an air supply port 19 on its top. The air supply port 19 takes air in the housing 2, and the air is drawn into the combustion fan 5 through the air supply channel 7.

The downstream end of the first heat exchanger 15 is connected to the upstream end of a heating terminal 20 (e.g., floor heater) via a supply channel 21. The upstream end of the first heat exchanger 15 is connected to the downstream end of the second heat exchanger 16. The upstream end of the second heat exchanger 16 is connected to the downstream end of the heating terminal 20 via a return channel 22. The return channel 22 includes a circulating pump 23 feeding a heating medium such as warm water to the second heat exchanger 16, and a return temperature sensor 24 sensing the temperature of the heating medium flowing into the second heat exchanger 16 (hereafter, the return temperature). The circulating pump 23 and the return temperature sensor 24 are electrically connected to the controller 40.

As described above, the second heat exchanger 16 collects the latent heat from the combustion exhaust gas generated by the burner 3. The heating medium fed to the second heat exchanger 16 by the operating circulating pump 23 is preheated with the collected heat and then fed to the first heat exchanger 15. The first heat exchanger 15 heats the heating medium through sensible heat exchange with the combustion exhaust gas generated by the burner 3. The resultant high-temperature heating medium is supplied to the heating terminal 20 through the supply channel 21. The supply channel 21 includes a supply temperature sensor 25 sensing the temperature of the heating medium flowing out of the first heat exchanger 15. The supply temperature sensor 25 is electrically connected to the controller 40. The return temperature sensor 24 or the supply temperature sensor 25 in the present embodiment correspond to a temperature sensor in an aspect of the present invention.

In the heating terminal 20, the heating medium flows through, for example, a serpentine pipe while radiating heat to warm the surroundings. The heating medium cooled through the heating terminal 20 returns to the circulating pump 23 through the return channel 22, and is fed to the second heat exchanger 16 again. The heating medium circulated through the heating terminal 20 may be other than warm water and may be silicone oil or another medium.

The supply channel 21 has a branch channel 26 dividing downstream from the supply temperature sensor 25 and connecting to the return channel 22 upstream from the circulating pump 23. The branch channel 26 includes a hot-water supply heat exchanger 27. A three-way valve 28 is provided at the connection point between the branch channel 26 and the return channel 22. The structure of the three-way valve 28 will be described later with reference to another drawing. The three-way valve 28 can change the distribution ratio at which the heating medium flowing out of the first heat exchanger 15 is distributed between the route through the heating terminal 20 and the route through the hot-water supply heat exchanger 27. The three-way valve 28 is electrically connected to the controller 40. The three-way valve 28 in the present embodiment corresponds to a distribution unit in an aspect of the present invention.

The hot-water supply heat exchanger 27 is a liquid-liquid heat exchanger, to which a water supply channel 30 and a hot-water channel 31 are connected. The water supply channel 30 allows service water to flow to the hot-water supply heat exchanger 27, at which the service water is heated through heat exchange with the heating medium, and the resultant hot water flows out into the hot-water channel 31. The water supply channel 30 includes a water flow sensor 32 for measuring the flow rate of the service water flowing into the heating and hot-water supply apparatus 1, a water flow servo 33 adjusting the flow rate of the service water, and a supply water temperature sensor 34 sensing the service water temperature. The hot-water channel 31 includes a heat exchanger exit temperature sensor 35 sensing the temperature of the hot water immediately after flowing out of the hot-water supply heat exchanger 27. The water flow sensor 32, the water flow servo 33, the supply water temperature sensor 34, and the heat exchanger exit temperature sensor 35 are electrically connected to the controller 40.

The heating and hot-water supply apparatus 1 according to the present embodiment includes a bypass channel 36 that connects the water supply channel 30 and the hot-water channel 31. After flowing into the heating and hot-water supply apparatus 1, the service water can partly pass through the bypass channel 36 rather than being entirely fed to the hot-water supply heat exchanger 27. The remaining service water is supplied to the hot-water supply heat exchanger 27. The hot water heated with the hot-water supply heat exchanger 27 mixes with the service water passing through the bypass channel 36, and then flows out of the heating and hot-water supply apparatus 1. A bypass servo 37 is provided at a connection point between the bypass channel 36 and the hot-water channel 31. The bypass servo 37 can change the mixing ratio of the hot water heated with the hot-water supply heat exchanger 27 and the service water passing through the bypass channel 36. The bypass servo 37 is electrically connected to the controller 40.

The hot-water channel 31 includes a hot-water temperature sensor 38 downstream from the bypass servo 37 for sensing the temperature of the hot water flowing out of the heating and hot-water supply apparatus 1. With the service water partly passing through the bypass channel 36 as described above, the sensed temperature at the hot-water temperature sensor 38 is lower than the sensed temperature at the heat exchanger exit temperature sensor 35. The bypass servo 37 can thus adjust the mixing ratio to stabilize the temperature of the hot water flowing out of the heating and hot-water supply apparatus 1.

The controller 40 is also connected to a remote control 41. The user can operate the remote control 41 to provide an instruction to start or stop the heating operation or set the warming temperature, or to switch between the enabled (ON) state and the disabled (OFF) state of the hot-water supply operation or set a hot-water supply temperature.

Figure 2A:
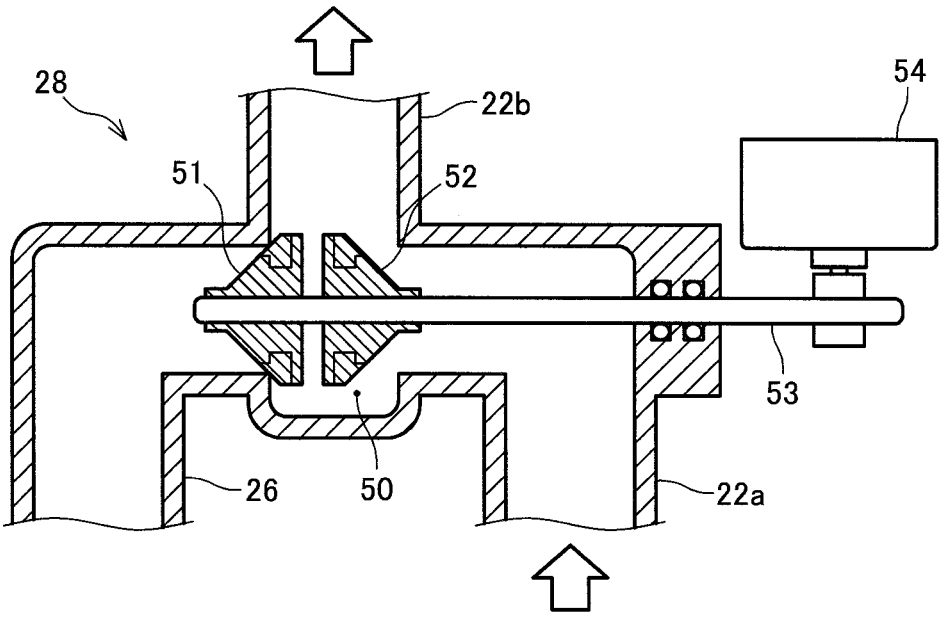
FIGS. 2A and 2B are cross-sectional views of a three-way valve 28 showing its structure.
Figure 2B:
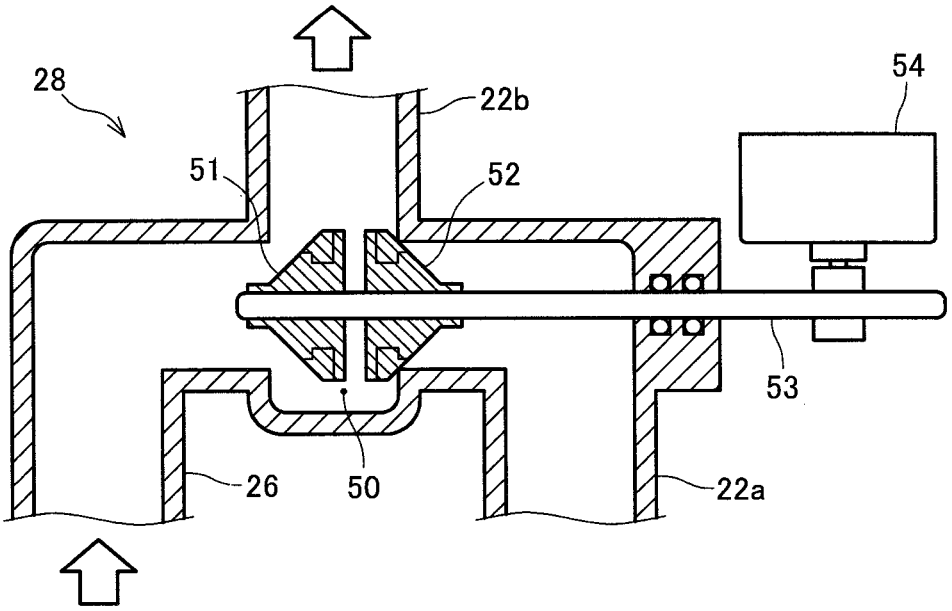

FIGS. 2A and 2B are cross-sectional views of the three-way valve 28. As shown in the figures, the three-way valve 28 includes an inner valve chamber 50 open in three directions. In the illustrated example, the left opening of the valve chamber 50 connects to the branch channel 26, the right opening and the upper opening connect to the return channel 22. The right opening connects to the section of the return channel 22 continuous with the heating terminal 20 (hereafter, the terminal-connected return channel 22*a*), and the upper opening connects to the section of the return channel 22 continuous with the circulating pump 23 (hereafter, the pump-connected return channel 22*b*).

The valve chamber 50 contains a hot-water supply channel valve element 51 opening and closing the branch channel 26 and a heating channel valve element 52 opening and closing the terminal-connected return channel 22*a*. The hot-water supply channel valve element 51 and the heating channel valve element 52 are arranged opposite to each other and attached to a movable shaft 53 that can reciprocate horizontally. The movable shaft 53 is driven by a drive motor 54. The drive motor 54 in the present embodiment is a stepper motor.

FIG. 2A shows the valve in which the movable shaft 53 has moved to the left with the hot-water supply channel valve element 51 closing the branch channel 26 and the heating channel valve element 52 opening the terminal-connected return channel 22*a*. In this state, the heating medium forced out of the first heat exchanger 15 by the operating circulating pump 23 circulates through the heating terminal 20 without being distributed to the hot-water supply heat exchanger 27. This is the heating operation.

When the drive motor 54 drives the movable shaft 53 to move to the right, as shown in FIG. 2B, the heating channel valve element 52 closes the terminal-connected return channel 22*a*, and the hot-water supply channel valve element 51 opens the branch channel 26. In this state, the heating medium forced out of the first heat exchanger 15 by the operating circulating pump 23 circulates through the hot-water supply heat exchanger 27 without being distributed to the heating terminal 20. This is the hot-water supply operation.

Figure 3:
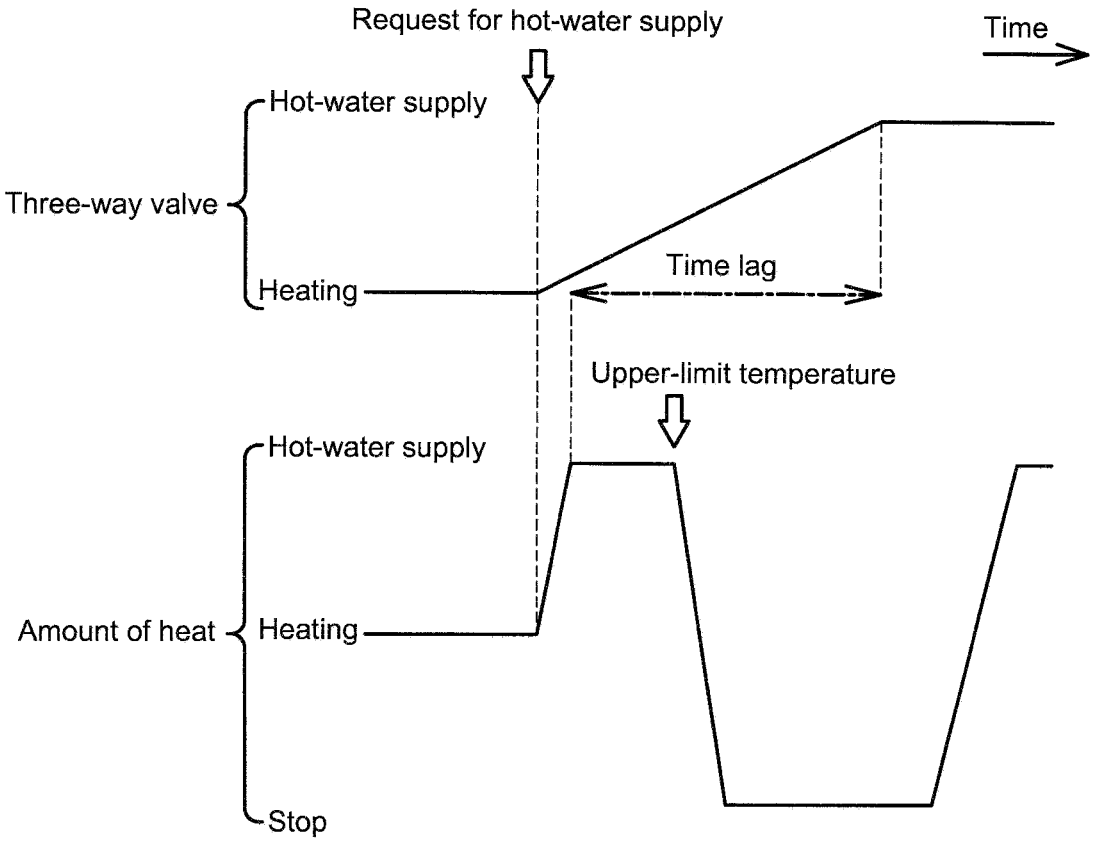
FIG. 3 is a graph showing the time taken for hot-water supply to stabilize at a set temperature in response to a request for the hot-water supply operation during the heating operation of a known heating and hot-water supply apparatus.

A known heating and hot-water supply apparatus that may implement the heating operation and the hot-water supply operation with the common heating medium may take time in the hot-water supply to stabilize at a set temperature in response to a request for the hot-water supply operation received during the heating operation. FIG. 3 is a graph showing the time taken for hot-water supply to stabilize at a set temperature in response to a request for the hot-water supply operation during the heating operation of the known heating and hot-water supply apparatus. The upper part of FIG. 3 shows a change over time in the state of the three-way valve 28, and the lower part schematically shows changes over time in the amount of heat generated by the burner 3.

As described above, the amount of heat generated by the burner 3 can be controlled by changing the rotational speed of the combustion fan 5. The hot-water supply operation typically uses more heat than the heating operation, and it means that the temperature (required temperature) of the heating medium increases accordingly. Thus, in response to a request for the hot-water supply operation during the heating operation, the rotational speed of the combustion fan 5 is increased to accelerate combustion of the burner 3.

In the three-way valve 28, the movable shaft 53 is driven by the drive motor 54 to switch from the state for the heating operation in FIG. 2A to the state for the hot-water supply operation in FIG. 2B. In this switching, moving the movable shaft 53 by the drive motor 54 takes a time period longer than a period for increasing the rotational speed of the combustion fan 5. A time lag occurs between the increase in the amount of heat generated by the burner 3 and the switch of the three-way valve 28.

Due to this time lag, a large amount of heating medium heated in an amount appropriate for the hot-water supply operation and having a high required temperature flows to the heating terminal 20. The heat of the heating medium to be consumed through heat exchange with service water in the hot-water supply heat exchanger 27 circulates without being consumed, causing a sudden increase in the temperature of the heating medium. Then, the sensed temperature at the supply temperature sensor 25 reaches a predetermined upper-limit temperature (90° C. in the present embodiment), and the burner 3 stops combustion to prevent the heating medium from overheating (or boiling). As a result, after the burner 3 restarts combustion, the hot-water supply takes time to stabilize at a set temperature.

In response to this, when the heating and hot-water supply apparatus 1 according to the present embodiment receives a request for the hot-water supply operation during the heating operation, the controller 40 performs a mid-heating procedure below during the heating operation to shorten the time taken for the hot-water supply to stabilize at a set temperature.

Figure 4:
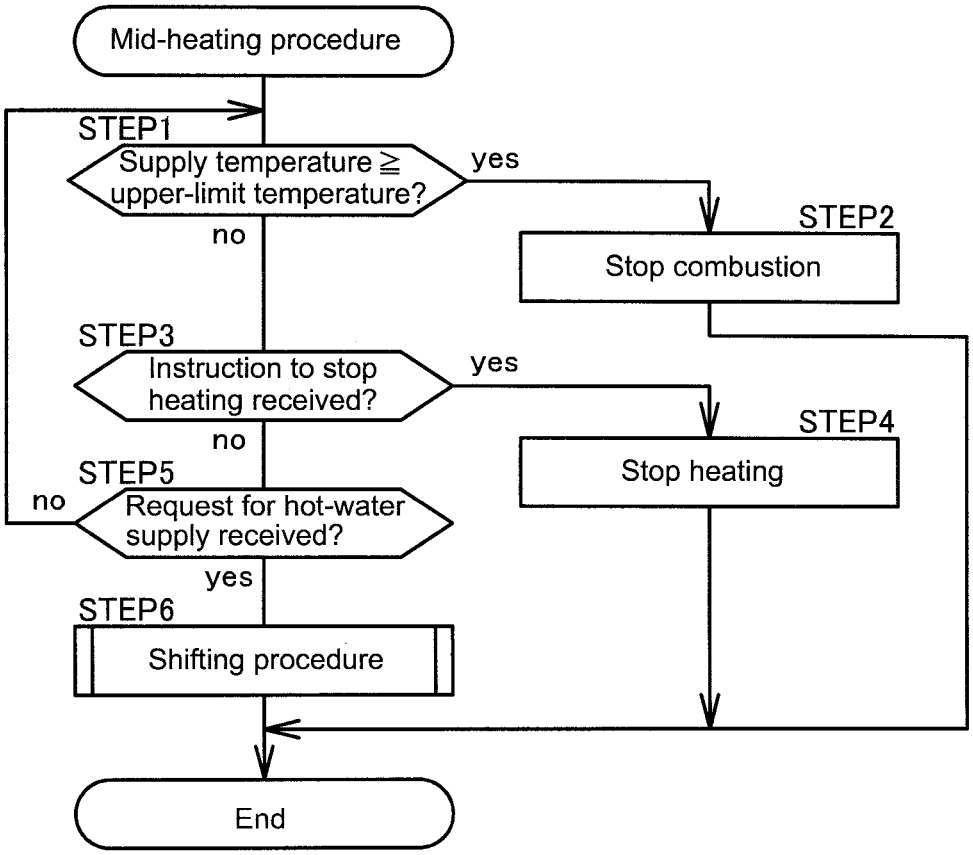
FIG. 4 is a flowchart of a mid-heating procedure performed by a controller 40 according to the embodiment.

FIG. 4 is a flowchart of the mid-heating procedure performed by the controller 40 according to the present embodiment. The mid-heating procedure is performed after the user operates the remote control 41 to start the heating operation. When the heating operation is started, the circulating pump 23 is operated with the three-way valve 28 in the state for the heating operation in FIG. 2A, and causes the burner 3 to start burning the mixture gas. The amount of heat generated by the burner 3 is set at an amount of heat for the heating operation (hereafter, the amount of heat for heating) in accordance with the set temperature for heating that is set on the remote control 41.

In the mid-heating procedure, the determination is first performed as to whether the heating medium temperature sensed at the supply temperature sensor 25 (hereafter, the supply temperature) is equal to or higher than the predetermined upper-limit temperature (90° C.) (Step 1). As described above, the upper-limit temperature is set to prevent the heating medium from overheating (or boiling). With the supply temperature equal to or higher than the upper-limit temperature (Step 1: Yes), the supply of the fuel gas is shut off to forcibly stop the combustion of the burner 3 (Step 2), and the mid-heating procedure in FIG. 4 ends. Then, when the supply temperature decreases to a predetermined ignition temperature lower than the upper-limit temperature and the burner 3 restarts combustion, the mid-heating procedure in FIG. 4 is performed again.

With the supply temperature lower than the upper-limit temperature (Step 1: No), the determination is performed as to whether an instruction to stop the heating operation is received (Step 3). With an instruction to stop the heating operation from the user operating the remote control 41 (Step 3: Yes), the heating operation is stopped (Step 4), and the mid-heating procedure in FIG. 4 ends. In Step 4, the combustion at the burner 3 is stopped, and then the circulating pump 23 is stopped. Subsequently, in response to an instruction to start the heating operation from the user operating the remote control 41, the heating operation is restarted. The mid-heating procedure in FIG. 4 is then performed again.

In contrast, without an instruction to stop the heating operation (Step 3: No), the determination is then performed as to whether a request for the hot-water supply operation is received (Step 5). With the hot-water supply operation enabled (ON) by an operation of the remote control 41, the user may turn on a hot-water tap (not shown), and then the flow rate of the service water measured at the water flow sensor 32 may become a predetermined rate or higher. In this case, the controller 40 in the present embodiment determines that a request for the hot-water supply operation is received. Without a request for the hot-water supply operation (Step 5: No), the mid-heating procedure returns to the start to repeat Step 1 and the subsequent steps. In response to a request for the hot-water supply operation (Step 5: Yes), a shifting procedure below is performed (Step 6). When resuming from the shifting procedure, the mid-heating procedure in FIG. 4 ends.

Figure 5:
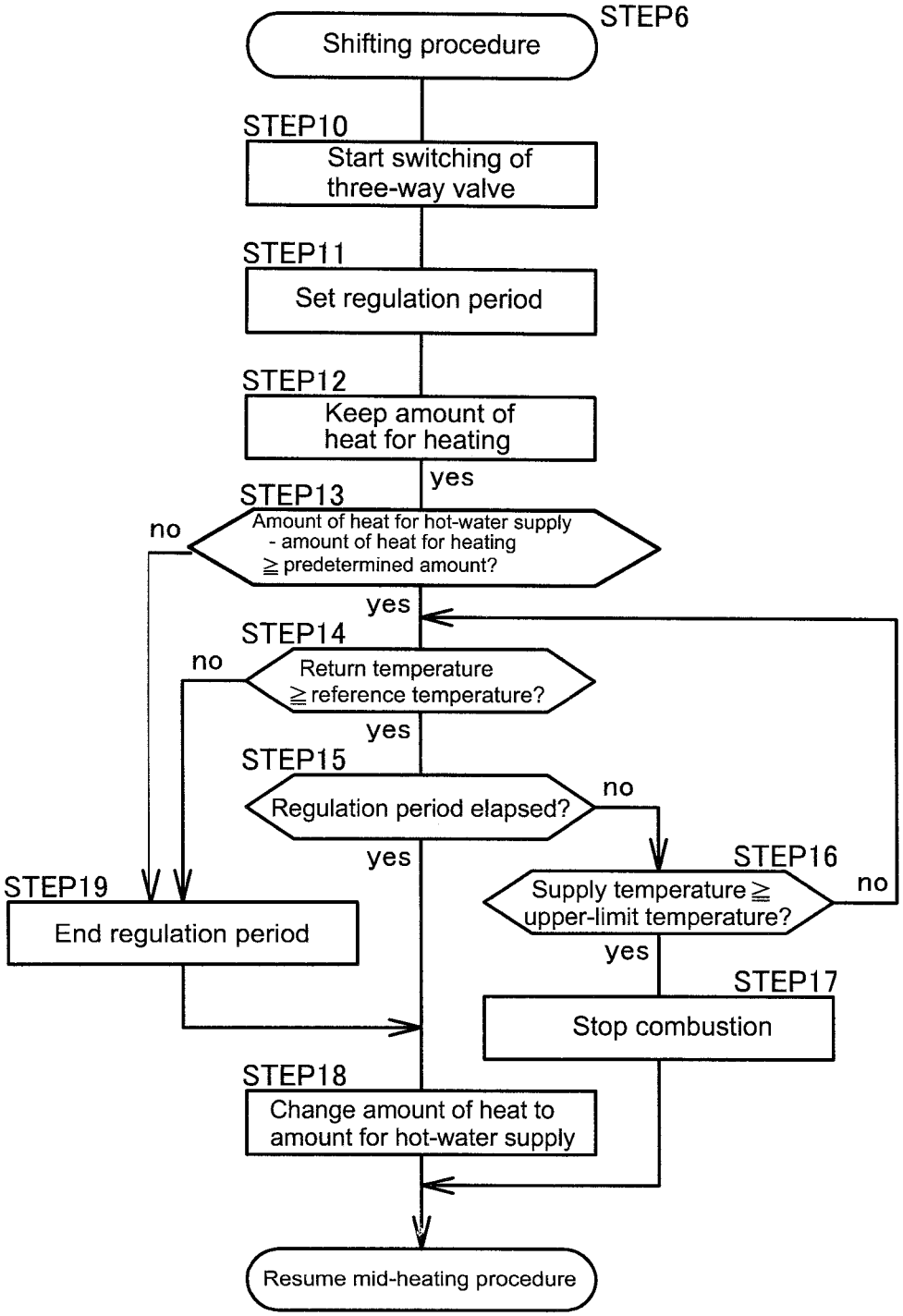
FIG. 5 is a flowchart of a shifting procedure according to the embodiment.

FIG. 5 is a flowchart of the shifting procedure according to the present embodiment. When the shifting procedure is started, the three-way valve 28 starts the switching operation (Step 10). As described above, the three-way valve 28 allows the drive motor 54 to drive the movable shaft 53, switching from the state for the heating operation in FIG. 2A to the state for the hot-water supply operation in FIG. 2B.

When the switching operation of the three-way valve 28 is started, a regulation period is set for regulating the amount of heat generated by the burner 3 to less than the amount of heat for the hot-water supply operation (hereafter, the amount of heat for hot-water supply) (Step 11). The heating and hot-water supply apparatus 1 according to the present embodiment sets the regulation period as the time taken for switching the three-way valve 28 from the state for the heating operation to the state for the hot-water supply operation. In this embodiment, during the regulation period, the current amount of heat generated by the burner 3 is kept unchanged (Step 12).

Subsequently, the determination is performed as to whether the difference between the amount of heat for hot-water supply and the amount of heat for heating is equal to or greater than a predetermined amount (150 kcal/min in the present embodiment) (Step 13). The amount of heat for hot-water supply is determined in accordance with the flow rate of the service water measured at the water flow sensor 32, the service water temperature sensed at the supply water temperature sensor 34, and the set temperature for the hot-water supply that is set on the remote control 41. The amount of heat for hot-water supply increases as the flow rate of the service water increases, the service water temperature decreases, or the set temperature for the hot-water supply increases. With the difference between the amount of heat for hot-water supply and the amount of heat for heating equal to or greater than the predetermined amount (Step 13: Yes), the determination is performed as to whether the heating medium temperature sensed at the return temperature sensor 24 (hereafter, the return temperature) is equal to or higher than a predetermined reference temperature (60° C. in the present embodiment) (Step 14).

With the return temperature equal to or higher than the reference temperature (Step 14: Yes), the determination is performed as to whether the regulation period set in Step 11 has elapsed (Step 15). Before the elapse of the regulation period (Step 15: No), the determination is performed as to whether the supply temperature is equal to or higher than the upper-limit temperature (90° C.) (Step 16). With the supply temperature equal to or higher than the upper-limit temperature (Step 16: Yes), the heating medium is determined to be overheating, and the combustion of the burner 3 is stopped (Step 17). Upon resuming from the shifting procedure in FIG. 5, the mid-heating procedure in FIG. 4 ends. Subsequently, when the supply temperature decreases to the predetermined ignition temperature, the combustion of the burner 3 is restarted to shift the mode to the hot-water supply operation.

In contrast, with the supply temperature lower than the upper-limit temperature (Step 16: No), the procedure returns to Step 14 to repeat the determination as to whether the return temperature is equal to or higher than the reference temperature (Step 14) and the determination as to whether the regulation period has elapsed (Step 15), and also monitor the supply temperature (Step 16). In repeating the processing in Steps 14 to 16, when the regulation period has elapsed (Step 15: Yes), the rotational speed of the combustion fan 5 is increased to change the amount of heat generated by the burner 3 from the amount of heat for heating to the amount of heat for hot-water supply (Step 18). Upon resuming from the shifting procedure in FIG. 5, the mid-heating procedure in FIG. 4 ends. The supply temperature is also monitored after shifting from the heating operation to the hot-water supply operation.

When the difference between the amount of heat for hot-water supply and the amount of heat for heating is determined to be less than the predetermined amount (150 kcal/min) in Step 13 (Step 13: No), the amount of heat for hot-water supply is not significantly greater than the current amount of heat for heating, and heating in the amount of heat for hot-water supply is less likely to overheat the heating medium. Thus, the regulation period ends (Step 19). And the amount of heat generated by the burner 3 is changed from the amount of heat for heating to the amount of heat for hot-water supply (Step 18).

When the return temperature is determined to be lower than the reference temperature (60° C.) in Step 14 (Step 14: No), the temperature of the heating medium is not significantly high, and heating in the amount of heat for hot-water supply is less likely to overheat the heating medium. Thus, the regulation period ends (Step 19), and the amount of heat generated by the burner 3 is changed from the amount of heat for heating to the amount of heat for hot-water supply (Step 18).

Figure 6:
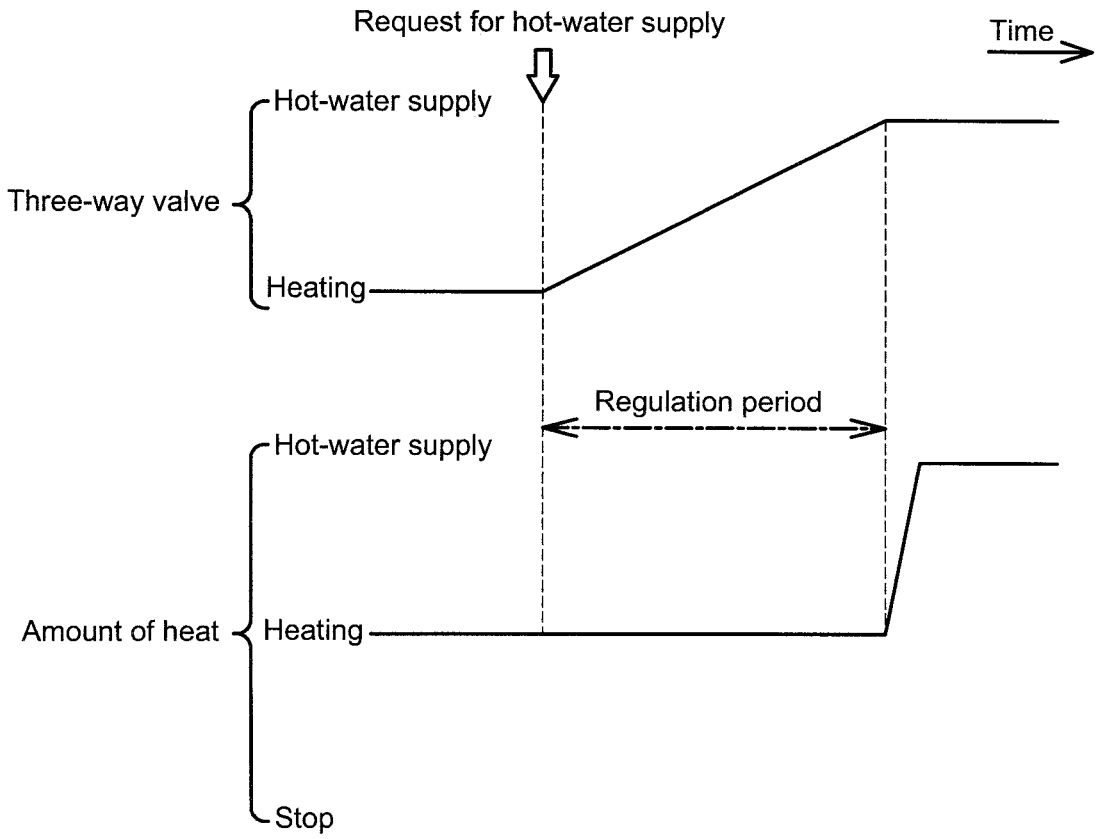
FIG. 6 is a graph showing the shift to the hot-water supply operation in accordance with the shifting procedure in response to a request for the hot-water supply operation during the heating operation of the heating and hot-water supply apparatus 1 according to the embodiment.

FIG. 6 is a graph showing the shift to the hot-water supply operation in accordance with the above shifting procedure in response to a request for the hot-water supply operation during the heating operation of the heating and hot-water supply apparatus 1 according to the present embodiment. In the same manner as shown in FIG. 3, the upper part of FIG. 6 shows a change over time in the state of the three-way valve 28, and the lower part schematically shows a change over time in the amount of heat generated by the burner 3.

In response to a request for the hot-water supply operation during the heating operation, the drive motor 54 (stepper motor) of the three-way valve 28 drives the movable shaft 53 to start switching the three-way valve 28 from the state for the heating operation in FIG. 2A to the state for the hot-water supply operation in FIG. 2B. Additionally, the regulation period is set at the time taken for switching the three-way valve 28.

During the regulation period, the amount of heat generated by the burner 3 is regulated to less than the amount of heat for hot-water supply. The heating and hot-water supply apparatus 1 according to the present embodiment keeps the current amount of heat for heating unchanged. After the switch of the three-way valve 28 and the elapse of the regulation period, the rotational speed of the combustion fan 5 is increased to switch the amount of heat generated by the burner 3 from the amount of heat for heating to the amount of heat for hot-water supply.

In this manner, in response to a request for the hot-water supply operation during the heating operation, the heating and hot-water supply apparatus 1 according to the present embodiment sets a regulation period for regulating the amount of heat generated by the burner 3. The period delays the heating medium starting to be heated in an amount of heat for hot-water supply. This prevents the supply temperature from reaching an upper-limit temperature, and shortens the time taken for the hot-water supply to stabilize at the set temperature without unnecessarily stopping the combustion by the burner 3.

In particular, the heating and hot-water supply apparatus 1 according to the present embodiment keeps the amount of heat generated by the burner 3 during the regulation period at the same amount of heat for heating as before starting switching the three-way valve 28. This regulates the temperature of the heating medium to lower than the upper-limit temperature, reliably preventing unnecessary stop of the combustion by the burner 3.

As described above, the overheat (or the sudden increase in the temperature) of the heating medium occurs when the heating medium heated in an amount of heat for hot-water supply and having a high required temperature flows to the heating terminal 20 while the three-way valve 28 is switching from the state for the heating operation to the state for the hot-water supply operation. Thus, the heating and hot-water supply apparatus 1 according to the present embodiment sets the regulation period as the time to be taken for switching the three-way valve 28. This regulation period prevents the amount of heat generated by the burner 3 from being over regulated for the hot-water supply operation, reducing a delay in the stabilization of the hot-water supply at a set temperature.

The heating and hot-water supply apparatus 1 according to the present embodiment also ends the regulation period earlier when the return temperature is lower than the reference temperature (60° C.). When the temperature of the heating medium is not significantly high, and heating in an amount of heat for hot-water supply is less likely to overheat the heating medium, the regulation period ends to shift to the amount of heat for hot-water supply. This allows the hot-water supply to stabilize earlier at a set temperature.

The heating and hot-water supply apparatus 1 according to the present embodiment also ends the regulation period when the difference between the amount of heat for hot-water supply and the amount of heat for heating is less than the predetermined amount (150 kcal/min). When the amount of heat for hot-water supply is not significantly greater than the amount of heat for heating, heating in an amount of heat for hot-water supply is less likely to overheat the heating medium, the regulation period ends to shift to the amount of heat for hot-water supply. This allows the hot-water supply to stabilize earlier at a set temperature.

The heating and hot-water supply apparatus 1 in the present embodiment may be modified as described below. Differences of the modification from the above embodiment will be described mainly. The same components in the modification as in the above embodiment will not be described in detail.

Figure 7:
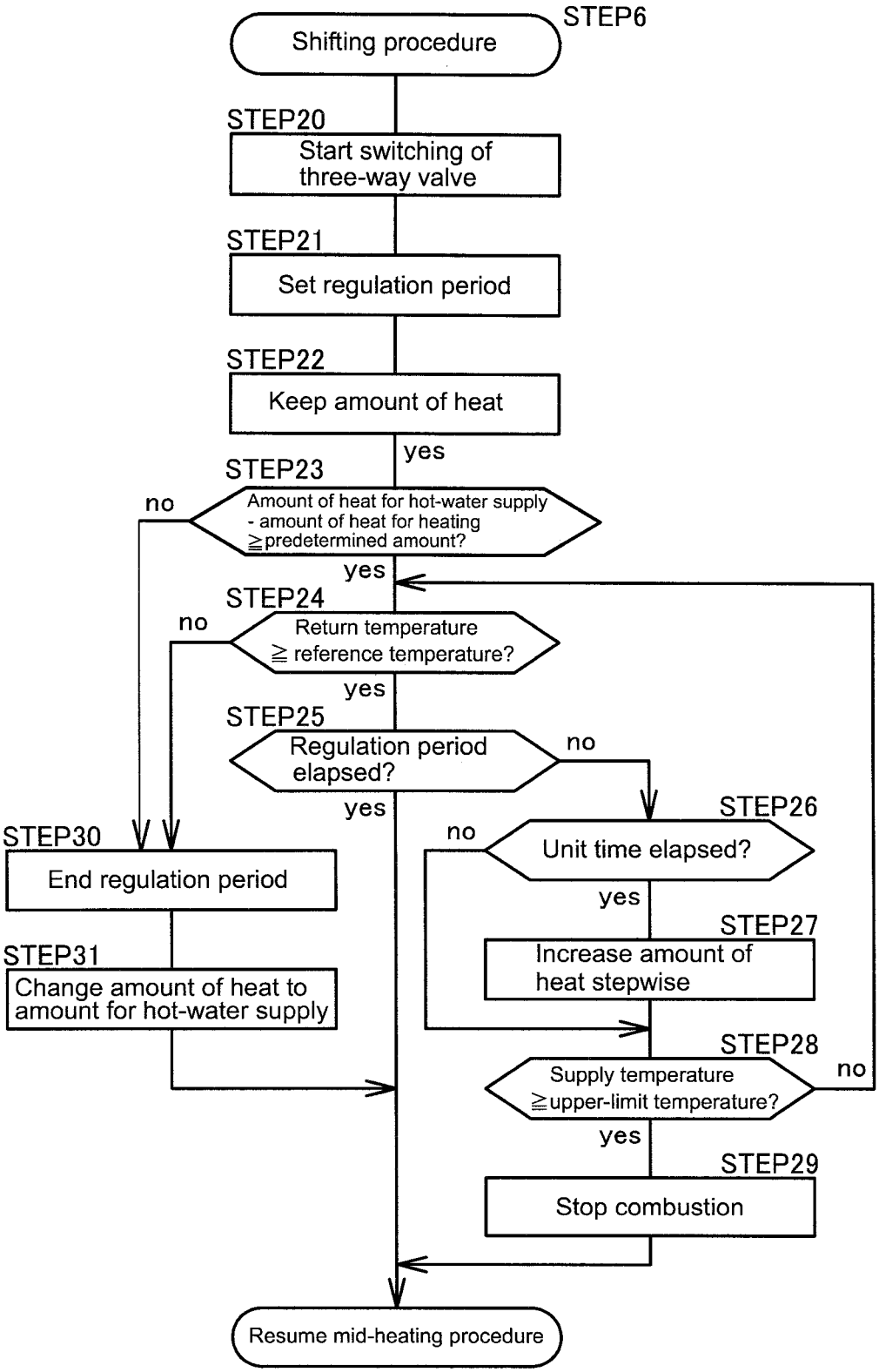
FIG. 7 is a flowchart of a shifting procedure according to a modification.

FIG. 7 is a flowchart of a shifting procedure according to a modification. When the shifting procedure according to the modification is started, the three-way valve 28 starts the switching operation (Step 20), and the regulation period is set for regulating the amount of heat generated by the burner 3 to less than the amount of heat for hot-water supply (Step 21). In the same manner as in the above embodiment, the regulation period in the modification is also set as the time to be taken for switching the three-way valve 28. The amount of heat generated by the burner 3 is then kept within amounts of heat for heating (Step 22).

Subsequently, the determination is performed as to whether the difference between the amount of heat for hot-water supply and the amount of heat for heating is equal to or greater than a predetermined amount (150 kcal/min) (Step 23). When the difference between the amount of heat for hot-water supply and the amount of heat for heating is equal to or greater than the predetermined amount (Step 23: Yes), the determination is performed as to whether the return temperature is equal to or higher than a reference temperature (60° C.) (Step 24). When the return temperature is equal to or higher than the reference temperature (Step 24: Yes), the determination is performed as to whether the regulation period set in Step 21 has elapsed (Step 25). Before the elapse of the regulation period (Step 25: No), the determination is performed as to whether a unit time has elapsed within the regulation period (Step 26).

The heating and hot-water supply apparatus 1 according to the modification divides the regulation period into multiple (e.g., ten) unit times. At the end of each unit time, the burner 3 increases the amount of heat in a stepwise manner toward the amount of heat for hot-water supply. When a unit time has elapsed (Step 26: Yes), the burner 3 increases the amount of heat by one step (Step 27). The amount of heat increased by one step may be determined by dividing the difference between the amount of heat for hot-water supply and the amount of heat for heating by the number of unit times of the regulation period.

In contrast, when a unit time has not elapsed (Step 26: No), Step 27 is skipped, and the determination is performed as to whether the supply temperature is equal to or higher than the upper-limit temperature (90° C.) (Step 28). When the supply temperature is equal to or higher than the upper-limit temperature (Step 28: Yes), the combustion of the burner 3 is stopped (Step 29). Upon resuming from the shifting procedure in FIG. 7, the mid-heating procedure in FIG. 4 ends.

In contrast, when the supply temperature is lower than the upper-limit temperature (Step 28: No), the procedure returns to Step 24 to repeat the determination as to whether the return temperature is equal to or higher than the reference temperature (Step 24: Yes) and the determination is performed as to whether the regulation period has elapsed (Step 25). At the end of each unit time, the burner 3 increases the amount of heat in a stepwise manner (Steps 26, 27), and the supply temperature is monitored (Step 28). In repeating the processing in Steps 24 to 28, when the regulation period has elapsed (Step 25: Yes), the shifting processing in FIG. 7 ends, and the mid-heating procedure in FIG. 4 is resumed. In the heating and hot-water supply apparatus 1 according to the modification, the burner 3 increases the amount of heat at the end of each unit time in a stepwise manner within the regulation period. Thus, at the end of the regulation period, the amount of heat generated by the burner 3 has reached the amount of heat for hot-water supply.

In contrast, when the difference between the amount of heat for hot-water supply and the amount of heat for heating is determined to be less than the predetermined amount (150 kcal/min) in Step 23 (Step 23: No) or when the return temperature is determined to be lower than the reference temperature (60° C.) in Step 24 (Step 24: No), the regulation period ends (Step 30), and the amount of heat generated by the burner 3 is changed from the amount of heat for heating to the amount of heat for hot-water supply (Step 31). Then, the shifting processing in FIG. 7 ends, and the mid-heating procedure in FIG. 4 is resumed.

Figure 8:
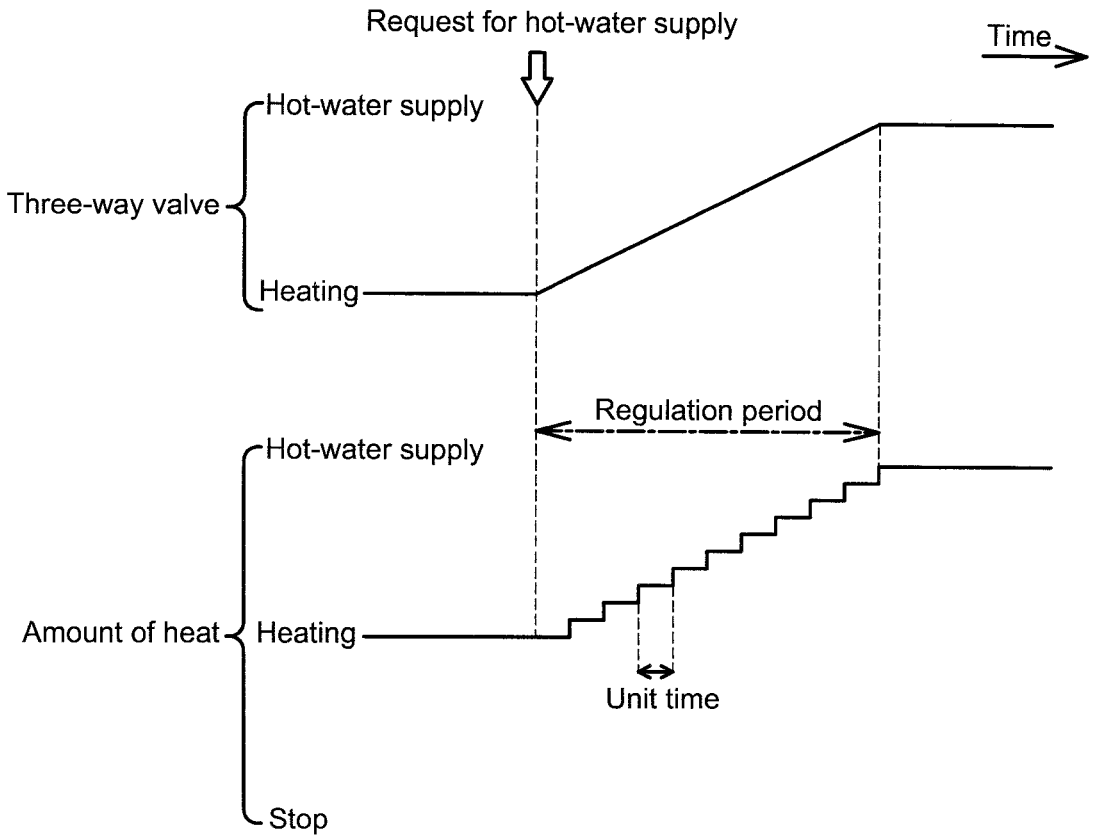
FIG. 8 is a graph showing the shift to the hot-water supply operation in accordance with the shifting procedure in response to a request for the hot-water supply operation during the heating operation of the heating and hot-water supply apparatus 1 according to the modification.

FIG. 8 is a graph showing the shift to the hot-water supply operation in accordance with the above shifting procedure in response to a request for the hot-water supply operation during the heating operation of the heating and hot-water supply apparatus 1 according to the modification. The upper part of FIG. 8 shows a change over time in the state of the three-way valve 28, and the lower part schematically shows changes over time in the amount of heat generated by the burner 3. In response to a request for the hot-water supply operation during the heating operation, the drive motor 54 of the three-way valve 28 drives the movable shaft 53 to start the switching from the state for the heating operation to the state for the hot-water supply operation. Additionally, the regulation period is set at the time taken for switching the three-way valve 28.

The regulation period in the modification is divided into the multiple (e.g., ten) unit times. At the end of each unit time, the burner 3 increases the amount of heat in a stepwise manner toward the amount of heat for hot-water supply. Then, at the end of the regulation period after the switch of the three-way valve 28, the amount of heat generated by the burner 3 has reached the amount of heat for hot-water supply.

In the heating and hot-water supply apparatus 1 according to the modification, the amount of heat generated by the burner 3 during the regulation period is not kept unchanged from the amount of heat for heating, but gradually (and monotonically) increased toward the amount of heat for hot-water supply. During the regulation period, the heating medium flowing to the hot-water supply heat exchanger 27 increases as the three-way valve 28 switches, and the heat of the heating medium is consumed through heat exchange with service water in the hot-water supply heat exchanger 27. Thus, the gradual increase in the amount of heat generated by the burner 3 prevents a sudden increase (or overheat) in the temperature of the heating medium. The amount of heat generated by the burner 3, while regulated, gradually (and monotonically) approaches the amount of heat for hot-water supply, shortening the time taken for the hot-water supply to stabilize at the set temperature.

Although the heating and hot-water supply apparatuses 1 according to the embodiment and the modification have been described, the embodiment and the modification disclosed herein should not be construed to be restrictive, but may be modified variously without departing from the scope and the spirit of the invention.

Figure 9:
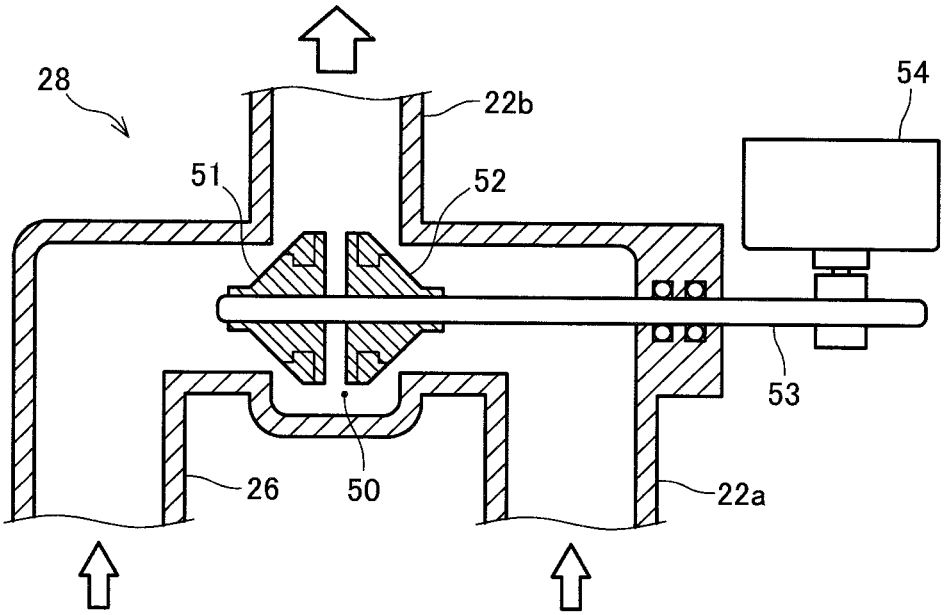
FIG. 9 is a cross-sectional view of the three-way valve 28 stopped in the middle state.

For example, in the above embodiment and modification, in response to a request for the hot-water supply operation during the heating operation, the heating operation is stopped to switch to the hot-water supply operation (switch the three-way valve 28 from the state for the heating operation to the state for the hot-water supply operation). However, as shown in FIG. 9, the three-way valve 28 may be stopped in the middle state between the state for the heating operation and the state for the hot-water supply operation (in the state with both the branch channel 26 and the terminal-connected return channel 22*a* open). In this state, the heating medium flowing out from the first heat exchanger 15 is distributed to both the heating terminal 20 and the hot-water supply heat exchanger 27 while circulating. This circulation allows the simultaneous operation of the heating operation and the hot-water supply operation.

The amount of heat for the simultaneous operation (hereafter, the amount of heat for simultaneous heating) is typically greater than the amount of heat for heating because the amount of heat for the hot-water supply operation is to be taken in addition to the amount of heat for the heating operation. The amount of heat for simultaneous heating may also be set at the approximately equal amount of heat for hot-water supply. Thus, also in shifting to the simultaneous operation in response to a request for the hot-water supply operation during the heating operation, a time lag may occur between the increase in the amount of heat generated by the burner 3 and the switch of the three-way valve 28. The time lag may cause a sudden increase in the temperature of the heating medium, and the burner 3 may stop combustion. In response to this, when the heating operation shifts to the simultaneous operation, the regulation period is set in the same manner as in the above embodiment and the modification. During the regulation period, the amount of heat generated by the burner 3 is regulated to less than the amount of heat for hot-water supply in the simultaneous operation. This prevents a sudden increase in the temperature of the heating medium, and shortens the time taken for the hot-water supply to stabilize at the set temperature without unnecessarily stopping the combustion by the burner 3. This regulation period may be set at the time taken for switching the three-way valve 28 from the state for the heating operation to the middle state.

In the above embodiment, the regulation period ends when the return temperature is lower than the reference temperature (60° C.). However, the regulation period may end when the supply temperature, instead of the return temperature, is lower than a predetermined temperature (e.g., 75° C.). The likelihood of the heating medium being overheated (to the upper-limit temperature) can be determined more accurately based on the temperature of the heating medium immediately after the heating by the first heat exchanger 15.

In the above embodiment, the amount of heat generated by the burner 3 during the regulation period is kept unchanged at the amount of heat for heating. In the above modification, the amount of heat generated by the burner 3 during the regulation period is gradually (and monotonically) increased toward the amount of heat for hot-water supply. However, the amount of heat generated by the burner 3 during the regulation period may be regulated to less than the amount of heat for hot-water supply in any other manner. For example, the regulation may be achieved by multiplying the amount of heat for hot-water supply by a predetermined reduction coefficient (e.g., 0.8).

In the above modification, the regulation period is divided into the multiple unit times, and at the end of each unit time, the burner 3 increases the amount of heat in a stepwise manner. However, the amount of heat generated by the burner 3 during the regulation period may not be increased in a stepwise manner, but may be increased continuously with time. The amount of heat generated by the burner 3 during the regulation period may be increased as the three-way valve 28 switches (the count of pulses input to the stepper motor, or the drive motor 54).

REFERENCE SIGNS LIST

1 heating and hot-water supply apparatus
2 housing
3 burner
4 combustion unit
5 combustion fan
6 joint
7 air supply channel
8 gas supply channel
9 zero governor
11 spark plug
12 flame rod
13 check valve
15 first heat exchanger
16 second heat exchanger
17 exhaust duct
18 exhaust port
19 air supply port
20 heating terminal
21 supply channel
22 return channel
23 circulating pump
24 return temperature sensor
25 supply temperature sensor
26 branch channel
27 hot-water supply heat exchanger

28 three-way valve
30 water supply channel
31 hot-water channel
32 water flow sensor
33 water flow servo
34 supply water temperature sensor
35 heat exchanger exit temperature sensor
36 bypass channel
37 bypass servo
38 hot-water temperature sensor
40 controller
41 remote control
50 valve chamber
51 hot-water supply channel valve element
52 heating channel valve element
53 movable shaft
54 drive motor

The invention claimed is:

1. A heating and hot-water supply apparatus for performing, using a common heating medium, a heating operation by circulating the heating medium through a heating terminal, and a hot-water supply operation of heating service water through heat exchange with the heating medium circulated through a hot-water supply heat exchanger and supplying hot water, the apparatus comprising: a heater configured to heat the heating medium; a temperature sensor configured to sense a temperature of the heating medium; a distribution unit valve configured to change a distribution ratio of the heating medium distributed between the heating terminal and the hot-water supply heat exchanger; and a controller configured to control an amount of heat generated by the heater in accordance with the heating operation or the hot-water supply operation, and stop heating with the heater when the temperature of the heating medium reaches a predetermined upper-limit temperature, wherein: when receiving a request for the hot-water supply operation during the heating operation with heating the heating medium, the controller sets a regulation period for regulating the amount of heat generated by the heater to less than an amount of heat for the hot-water supply operation; and when the controller receives the request, the distribution valve starts changing the distribution ratio, and continues or ends the changing of the distribution ratio within the regulation period.

2. The heating and hot-water supply apparatus according to claim 1, wherein the regulation period has a length being a time taken for the distribution unit valve to change the distribution ratio.

3. The heating and hot-water supply apparatus according to claim 1, wherein the controller ends the regulation period when the temperature of the heating medium is lower than a predetermined reference temperature below the upper-limit temperature.

4. The heating and hot-water supply apparatus according to claim 1, wherein the controller ends the regulation period when a difference between an amount of heat for the hot-water supply operation and an amount of heat for the heating operation is less than a predetermined amount.

5. The heating and hot-water supply apparatus according to claim 1, wherein the controller keeps the amount of heat generated by the heater during the regulation period at the amount of heat for the heating operation.

6. The heating and hot-water supply apparatus according to claim 1, wherein the controller monotonically increases the amount of heat generated by the heater during the regulation period toward the amount of heat for the hot-water supply operation.

* * * * *